United States Patent [19]

Aotsuka et al.

[11] Patent Number: 4,558,002

[45] Date of Patent: Dec. 10, 1985

[54] PHOTOGRAPHIC PAPER MATERIAL WITH RESIN COATINGS AND PIGMENT MIXTURE

[75] Inventors: Yasuo Aotsuka; Soichiro Yamamoto, both of Kanagawa, Japan

[73] Assignee: Fuji Photo Film Co., Ltd., Kanagawa, Japan

[21] Appl. No.: 593,797

[22] Filed: Mar. 27, 1984

[30] Foreign Application Priority Data

Mar. 29, 1983 [JP] Japan ..... 58-547401

[51] Int. Cl.[4] ..... G03C 1/86

[52] U.S. Cl. ..... 430/538; 430/531; 430/536

[58] Field of Search ..... 430/538, 531, 536

[56] References Cited

U.S. PATENT DOCUMENTS

| | | | |
|---|---|---|---|
| 3,369,901 | 2/1968 | Fogg et al. | 430/538 |
| 3,501,298 | 3/1970 | Crawford | 430/538 |
| 3,582,339 | 6/1971 | Martens | 430/538 |
| 4,169,188 | 9/1979 | Nagai et al. | 428/513 |
| 4,209,584 | 6/1980 | Joseph | 430/538 |
| 4,220,471 | 9/1980 | Date et al. | 430/538 |
| 4,237,206 | 12/1980 | Fujita | 430/538 |
| 4,296,198 | 10/1981 | Trautweiler | 430/538 |
| 4,312,937 | 1/1982 | Kasper et al. | 430/538 |

FOREIGN PATENT DOCUMENTS 64325 4/1982 Japan .

*Primary Examiner*—Jack P. Brammer

*Attorney, Agent, or Firm*—Sughrue, Mion, Zinn, Macpeak & Seas

[57] ABSTRACT

A photographic paper material comprising (1) a paper support coated on both sides with a synthetic resin film, (2) a hydrophilic colloid layer containing a white pigment provided on one side of the paper support (1), and (3) a light-sensitive silver halide emulsion layer on the hydrophilic colloid layer (2), wherein a dye or pigment which is not decolored during photographic processing is present in the hydrophilic colloid layer (2) and/or the synthetic resin film on the paper support (1).

8 Claims, No Drawings

PHOTOGRAPHIC PAPER MATERIAL WITH RESIN COATINGS AND PIGMENT MIXTURE

FIELD OF THE INVENTION

The present invention relates to a photographic paper material using a synthetic resin film-coated paper substrate as a support. More particularly, it is concerned with a photographic paper material, which is improved so that even if finished photographic images are observed under varied conditions, the image density contrast is kept constant and, furthermore, the degree of whiteness of the white background is maintained in a good condition.

The present invention further relates to a photographic paper material comprising a synthetic resin film coated paper substrate as a support, which has improved image sharpness.

BACKGROUND OF THE INVENTION

In view of the recent tendency to speed up the photographic processing of photographic light-sensitive materials, a so-called water-resistant photographic paper utilizing a polyolefin-coated paper as a support has been developed and put to practical use. These water-resistant photographic papers using as a support a paper substrate, both surfaces of which are coated with a polyolefin, a hydrophobic resin, have advantages in that fatigue of the developer can be reduced and the time required for rinsing and drying after development can be greatly shortened, since the support absorbs the developer to a lesser extent. Furthermore, these supports have superior dimensional stability.

However, when compared with photographic images formed with conventional photographic paper materials using a baryta-coated paper as a support, the photographic images formed in photographic paper materials utilizing a polyolefin-coated paper as a support have a disadvantage in that the image density contrast and the degree of whiteness of the white background vary depending on conditions under which the photographic images are observed. That is, under certain conditions, they look as if they were deteriorated. For example, when photographic images on poly-olefin coated paper are looked at, a clear distinction can be observed between the case where they are placed on a white plate and the case where they are placed on a black plate. That is, when the photographic images are placed on the black plate, the entire image looks as if it were blackened, and this is more noticeable in areas with a white background. As a result, it looks as if the image contrast drops and the degree of whiteness of the white background is deteriorated. On the other hand, with photographic images on baryta-coated paper, the above-described phenomenon does not occur or occurs only to a limited extent. Similarly, when photographic images on poly-olefin coated paper are observed not on plates as described above but while they are held in the air, their image contrast looks as if it was reduced, in comparison with photographic images on baryta-coated paper.

The cause of the phenomenon is believed to be due to the light-barrier effect of white pigment incorporated in the polyolefin layer of the support, this polyolefin layer being in contact with a light-sensitive silver halide emulsion layer. In particular, the light-barrier effect is insufficiently obtained since the amount and volume-occupying ratio of the white pigment are small. Therefore, part of light is allowed to pass through the support.

Furthermore, when compared with photographic images formed in conventional photographic paper materials utilizing a baryta-coated paper as a support, photographic images formed in photographic paper materials using a polyolefin-coated paper as a support have the disadvantage that the sharpness is poor. The cause of the poor sharpness is also believed to be due to the light-barrier effect of white pigment incorporated in the polyolefin layer of the support, this polyolefin layer being in contact with a light-sensitive silver halide emulsion layer, which light-barrier effect is obtained only insufficiently since the amount and volume-occupying ratio of the white pigment are small and, therefore, halation occurs in the polyolefin layer.

However, incorporation of a large amount of white pigment in the polyolefin layer to obtain a sufficiently high light-barrier effect is not suitable since this seriously reduces the film-forming properties of polyolefin.

In order to improve the reduction in sharpness among the above-described defects, Japanese Patent Application (OPI) No. 64235/82 (the term "OPI" as used herein means a "published unexamined Japanese patent application) discloses a method in which a hydrophilic colloid layer containing white pigment and a dye capable of being decolored during the process of development is sandwiched between a polyolefin-coated paper support and a light-sensitive silver halide emulsion layer. In accordance with this method, however, the dye is decolored after the process of development and the white pigment alone remains in the hydrophilic colloid layer. Thus, the image contrast still varies depending on the observation conditions and, furthermore, the degree of whiteness is not good.

SUMMARY OF THE INVENTION

The present invention overcomes the above-described problems.

An object of the present invention is to provide a photographic paper material capable of providing photographic images in which the image sharpness is high and the degree of whiteness is good and, furthermore, the image contrast and the degree of whiteness are constant and do not vary depending on the observation conditions.

The present invention thus provides a photographic paper material comprising (1) a paper support, both sides of the paper support being coated with a synthetic resin film, (2) a hydrophilic colloid layer on the paper support (1), the hydrophilic colloid layer containing a white pigment, and (3) a light-sensitive silver halide emulsion layer on the hydrophilic colloid layer (2), wherein a dye or pigment which is not decolored during photographic processing is present in the hydrophilic colloid layer (2) and/or the synthetic resin film of the paper support (1).

DETAILED DESCRIPTION OF THE INVENTION

Synthetic resin films which are preferably used in the present invention are films made of polyolefins. An especially preferred synthetic resin film is a polyethylene film.

In the photographic paper material of the present invention, it is preferred for the hydrophilic colloid layer containing the white pigment to be in contact with the synthetic resin film of the paper support.

In photograhic images formed in the usual water-resistant photographic paper material comprising a polyolefin-coated paper support and a light-sensitive silver halide emulsion layer, gelatin added to the silver halide emulsion layer and a white pigment incorporated in the polyolefin layer in contact with the silver halide emulsion layer and covering the paper substrate seem to be yellowish. For this reason, the color of the entire photographic images, particularly the degree of whiteness of the white background is reduced.

As a technique to overcome the above-described problem, a method is well known, as described in U.S. Pat. No. 4,169,188, in which a blue or red dye or pigment is incorporated into the polyolefin layer in contact with the silver halide emulsion layer of the polyolefin layers covering the paper substrate. In this method, however, the dye or pigment can be incorporated into the polyolefin layer only in very limited amounts. More specifically, as described in Japanese Patent Application (OPI) No. 19021/78, the amount of the dye or pigment is limited so that the surface reflection characteristics measured and expressed according to JIS Z8730 fall within the ranges of L=90 or more, a=0.5–1.5, and b=(−3)–(−5). The reason for this is that if the dye or pigment is added in excess of the above limit, the photographic images rather become bluish or greenish, resulting in a reduction in the degree of whiteness.

In accordance with the present invention, however, it has been found that even if the amount of the dye or pigment added to the synthetic resin film (polyolefin layer) in contact with the hydrophilic colloid layer containing the white pigment is increased to 1.3 to 2 times that in the usual water-resistant photographic paper material, a reduction in the degree of whiteness does not occur. This means that the amount of the dye or pigment added is such that the surface reflection rate determined according to JIS Z8730 is 70% or less at 400–700 nm.

The reason why a reduction in the degree of whiteness does not occur, but rather a preferred degree of whiteness is obtained, even if the dye or pigment is present in such large amounts that would not have been possible to consider previously, is believed to be due to the light barrier effect of the hydrophilic colloid layer containing the white pigment, in that only part of the light is allowed to reach the polyolefin-coated paper when the photographic images are observed. As a result of this, the color of the polyolefin layer seems to the observer to be very pale.

In the photographic images formed in the photographic paper material of the present invention, since the light filter effect of the polyolefin layer containing a large amount of dye or pigment is added to a certain extent to the light-barrier effect of the hydrophilic colloid layer containing the white pigment, substantially no light is allowed to pass through the polyolefin-coated paper support and the white pigment-containing hydrophilic colloid layer. Hence, even if the photographic images are observed under varied conditions, for example, on a white or black plate or while they are held in the air, the image contrast and the degree of whiteness of the white background always seem to be constant.

It has further been found that when a photographic image is printed on the photographic paper material of the present invention, the presence of the polyolefin layer in contact with the white pigment-containing hydrophilic colloid layer and further containing a large amount of dye or pigment enables the sharpness of the photographic image to be increased compared with the case while only a white pigment-containing hydrophilic layer is present. It is heretofore well known that if a layer containing a dye or pigment is provided in contact with a light-sensitive silver halide emulsion layer and, furthermore, is interposed between the silver halide emulsion layer and the support, the so-called antihalation effect is produced. This results in an increase in the sharpness of the image, but simultaneously in a reduction in the sensitivity. On the other hand, when a white pigment-containing hydrophilic colloid layer is provided in contact with a light-sensitive silver halide emulsion layer and a dye or pigment-containing layer is provided on the opposite side of the white pigment-containing layer relative to the light-sensitive silver halide emulsion layer, the sharpness is increased without a reduction in sensitivity occurring. This is different from the above-described antihalation effect. Although the mechanism of this phenomenon is not yet clear, it is believed that the sharpness is increased since the dye or pigment content of the polyolefin layer can be increasd to high levels which have not previously been possible to reach and further, since the white pigment-containing layer is in contact with the silver halide emulsion layer, the sensitivity does not drop.

With regard to a method of incorporating a dye or pigment not into a polyolefin layer but into a white pigment-containing hydrophilic colloid layer, a similar method is disclosed in Japanese Patent Application (OPI) No. 64235/82. The dyes to be used in this method, however, are limited to those dyes having an absorption in the spectral sensitivity region of a light-sensitive silver halide emulsion layer. On the other hand, in the present invention, the absorption of the dye or pigment used should be chosen so that the degree of whiteness of the white background of the finished photographic images is good depending on the type of a white pigment used in the white pigment-containing hydrophilic colloid layer, i.e., the color of the white pigment. That is, the white pigment is chosen irrespective of the spectral sensitivity of the silver halide emulsion layer. Furthermore, the dyes used in Japanese Patent Application (OPI) No. 64235/82 are limited to those dyes capable of being decolored during the photographic processing. On the other hand, the dyes or pigments used in the present invention are limited to those dyes or pigments which are not decolored during the photographic processing. The reason is that if they are decolored during the photographic processing, it will be impossible to increase the degree of whiteness of the finished photographic images.

Unexpectedly, it has been found according to the present invention that even if the dyes or pigments not decolored during the photographic processing are used, the sharpness can be increased.

The presence of the dyes or pigments in the white pigment-containing hydrophilic colloid layer without being decolored even after the photographic processing produces another significant effect. That is, the image contrast and the degree of whiteness of the white background seem to be always constant even if the observation conditions are changed, as is the case with the photographic images formed in the photographic paper material as described above in which a large amount of dye or pigment is incorporated in the polyolefin layer and the white pigment-containing hydrophilic colloid layer is sandwiched between the polyolefin layer and the light-sensitive silver halide emulsion layer.

When the dyes or pigments are incorporated into the white pigment-containing hydrophilic colloid layer, it is inevitably necessary for the dye or pigment content to be decreased, in comparison with the case where the dyes or pigments are introduced into the polyolefin layer, in order to maintain the degree of whiteness at a satisfactory level. If, however, the dyes or pigments are present in the white pigment-containing hydrophilic colloid layer, the light barrier effect is greatly increased even though the dye or pigment content is small.

The reason for this is believed as follows:

When light passes through the white pigment-containing layer, it is almost impossible for the light to pass through in a straight line from one side of the white pigment-containing layer to the other side. That is, the light advances while it is scattered whenever it strikes a white pigment grain. Hence, for the light to travel from one side to the other side, a very long path should be followed, which is several or several ten times longer than the path where the light advances in a straight line. For this reason, if the dye or pigment is present in the white pigment-containing layer, the light filter effect of the dye or pigment is increased to several or several ten times that obtained when the white pigment is not present.

When the dyes or pigments are present in the white pigment-containing hydrophilic colloid layer, it is preferred for the amount of the dyes or pigments to be determined so that the surface reflection characteristics, as determined by the method defined in JIS Z8730, when they are coated in combination with a white pigment on a synthetic resin film-coated paper support are within the ranges of L=90 or more, a=0.5-1.5, and b=(−3)-(−5).

A more preferred effect can be obtained if the white pigment is present in the polyolefin layer on which the silver halide emulsion layer is to be provided, of the polyolefin layers covering the paper substrate. When the white pigment is present in the polyolefin layer, it is preferred for the amount of the white pigment to be not more than about 30% by volume, particularly from 10 to 20% by volume of the polyolefin layer and the white pigment.

Suitable white pigments which can be used in the present invention include titanium dioxide, barium sulfate, lithopone, alumina white, calcium carbonate, silica white, antimony trioxide, and titanium phosphate. Of these pigments, titanium dioxide is particularly effective. The titanium dioxide may be either of the rutile type or of the anatase type and, furthermore, the titanium dioxide may be produced by any of the sulfate method and the chloride method.

With regard to the grain size of the white pigment used in the hydrophilic colloid layer, the mean grain size can be between about 0.1 and about 1.0μ. Preferably the mean grain size is between 0.2 and 0.3μ.

The white pigment content of the white pigment-containing hydrophilic colloid layer of the present invention is effective when it is not less than 30% by volume of the hydrophilic colloid layer and the white pigment. In particular, a remarkable effect can be obtained if the white pigment content is not less than 40% by volume.

It is preferred for the dyes and pigments are used herein to have a maximum absorption within the region of from 500 to 800 nm. Typical examples are organic dyes such as anthraquinones, azo compounds, phthalocyanines, indigos, thioindigos, quinophthalones, azomethines, and indophenols, and inorganic dyes such as ultramarine.

Representative examples of the dyes which can be used in the present invention are shown below, although the present invention is not to be construed as being limited to these dyes.

1. C.I. Solvent Green 3
2. C.I. Solvent Blue 11
3. Sumiplust Blue BGM
4. C.I. Solvent Red 158
5. C.I. Solvent Red 25
6. Diapolon Brilliant Blue BS
7. C.I. Solvent Blue 25
8. Aizen Spilon Blue GNH
9. C.I. Solvent Blue 55
10. C.I. Reactive Blue 38
11. C.I. Vat Blue 1
12. C.I. Vat Blue 4
13. C.I. Vat Blue 5
14. C.I. Vat Blue 6

15.

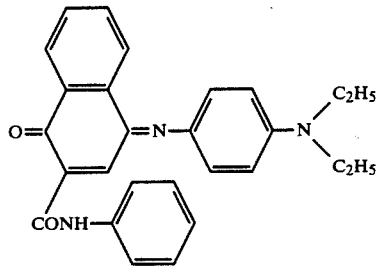

16.

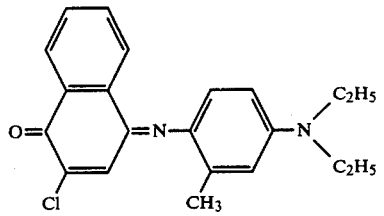

17.

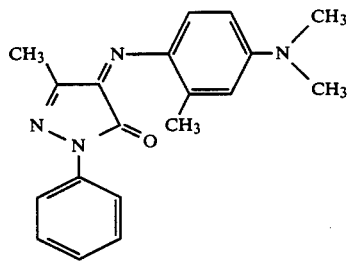

18. Diamira Brillant Green 6B

19.

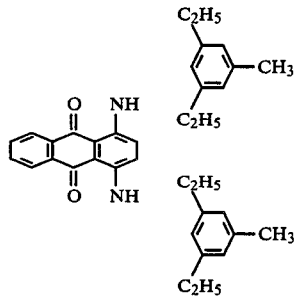

20.

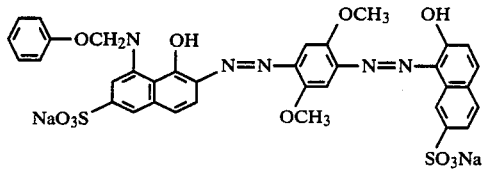

21. Bluish ultramarine
22. Reddish ultramarine
23. Cobalt Blue
24. Cerulean Blue
25. Daiichi Violet DV-1
26. Daiichi Pink DP-1
27. C.I. Vat Violet 9
28. C.I. Vat Violet 1
29. C.I. Vat Orange 7
30. C.I. Vat Orange 9
31. C.I. Direct Blue 168

Gelatin can be advantageously used as the hydrophilic colloid to be used in the white pigment-containing hydrophilic colloid layer, the silver halide emulsion layer, etc. of the present invention. Of course, other hydrophilic colloids can be used, if desired.

For example, proteins such as gelatin derivatives, graft polymers of gelatin and other polymers, albumin, and casein; saccharide derivatives such as cellulose derivatives (e.g., hydroxyethyl cellulose, carboxymethyl cellulose, and cellulose sulfate), sodium alginate, and starch derivatives; and a wide variety of synthetic hydrophilic polymeric substances, homopolymers or copolymers, such as polyvinyl alcohol, polyvinyl alcohol partial acetal, poly(N-vinylpyrrolidone), polyacrylic acid, polymethacrylic acid, polyacrylamide, polyvinyl imidazole, and polyvinyl pyrazole can be used.

The thickness of the white pigment-containing layer is usually from about 0.5 to about 10 μm and preferably from 2 to 5 μm.

Various chemical sensitizers can be used in the silver halide emulsions for use in the preparation of the photographic paper material of the present invention. For chemical sensitization, a sulfur sensitization method using sulfur-containing compounds capable of reacting with active gelatin and silver (e.g., thiosulfate salts, thioureas, mercapto compounds, and rhodamines), a reduction sensitizing method using reducing substances (e.g., stannous salts, amines, hydrazine derivatives, formamizine derivatives, formamizinesulfinic acid, and silane compounds), a noble metal sensitization method using nobel metal compounds (e.g., gold complex salts and complex salts of Group VIII metals of the Periodic Table, such as Pt, Ir and Pd), and so forth can be used alone or in combination with each other.

The sulfur sensitization method which can be used is described in, for example, U.S. Pat. Nos. 1,574,944, 2,410,689, 2,278,947, 2,728,668, and 3,656,955. The reduction sensitization method is described in, for example, U.S. Pat. Nos. 2,983,609, 2,419,974, and 4,054,458. The noble metal sensitization method which can be used is described in, for example, U.S. Pat. Nos. 2,399,083, 2,448,060, and British Patent 618,061.

Various compounds can be incorporated into the photographic emulsions as used herein for the purpose of preventing fog during the production, storage or photographic processing of the light-sensitive material, or for the purpose of stabilizing the photographic performance. That is, many compounds known as antifoggants or stabilizers, such as azoles (e.g., benzothiazolium salts, nitroindazoles, triazoles, benzotriazoles, and benzimidazoles, particularly nitro or halogen-substituted benzimidazoles); heterocyclic mercapto compounds (e.g., mercaptothiazoles, mercaptobenzothiazoles, mercaptobenzimidazoles, mercaptothidiazoles, mercaptotetrazoles, particularly 1-phenyl-5-mercaptotetrazole, and mercaptopyrimidines); the foregoing heterocyclic mercapto compounds containing a water-soluble group (e.g., a carboxyl group and a sulfone group); thioketone compounds (e.g., oxazolinethione); azaindenes (e.g., tetraazaindenes, particularly 4-hydroxy-substituted (1,3,3a,7)tetraazaindenes); benzenethiosulfonic acids; and benzenesulfinic acids, can be employed.

The photographic emulsion layers and other hydrophilic colloids layers of the light-sensitive material of the present invention may contain various surfactants for various purposes; for example, as coating aids, or for the purpose of preventing electrostatic charging, improving sliding properties, accelerating emulsification and dispersion, or for improving photographic properties (e.g., acceleration of development, hardening, and sensitization).

Surfactants which can be used include nonionic surfactants such as saponin (steroid), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, and polyethylene oxide adducts of silicone), glycidol derivatives (e.g., alkenylsuccinic acid polyglyceride and alkylphenol polyglyceride), fatty acid esters of polyhydric alcohols, and alkyl esters of saccharides; anionic surfactants containing an acidic group (e.g., a carboxyl group, a sulfo group, a phospho group, a sulfate group, and a phosphate group), such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurins, sulfosuccinic acid esters, sulfoalkyl polyoxyethylene alkyl phenyl ethers, and polyoxy ethylene alkyl phosphoric acid esters; amphoteric surfactants such as amino acids, aminoalkylsulfonic acids, aminoalkylsulfuric acid or phosphoric acid esters, alkylbetaines, and amine oxides; and cationic surfactants such as alkylamine salts, aliphatic or aromatic quaternary ammonium salts, heterocyclic quaternary ammonium salts (e.g., pyridinium and imidazolium salts), and aliphatic or heterocyclic phosphonium or sulfonium salts.

The light-sensitive material of the present invention may contain inorganic or organic hardeners in the photographic emulsion layers or other hydrophilic colloid layers thereof. For example, chromium salts (e.g., chromium alum and chromium acetate), aldehydes (e.g., formaldehyde, glyoxal, glutaraldehyde, etc.), N-methylol compounds (dimethylolurea and methyloldimethylhydantoin), dioxane derivatives (e.g., 2,3-dihydroxydioxane), active vinyl compounds (e.g., 1,3,5-triacryloyl-hexahydro-s-triazine, and 1,3-vinylsulfonyl-2-propanol), active halo compounds (e.g., 2,4-dichloro-6-hydroxyl-s-triazine), and mucohalic acids (e.g., mucochloric acid and mucophenoxychloric acid) can be used alone or in combination with each other.

The photographic emulsion layers of the light-sensitive material of the present invention may contain color-forming couplers, i.e., compounds capable of forming color through oxidative coupling with aromatic primary amine developers (e.g., phenylenediamine derivatives and aminophenol derivatives) in the color developing process. For example, a 5-pyrazolone coupler, a pyrazolobenzimidazole coupler, a cyanoacetylcumarone coupler, and an open chain acylacetonitrile coupler can be used as magenta couplers; an acylacetamide coupler (e.g., benzoylanilides and pivaroylacetoanilides) can be used as yellow couplers; and a naphthol coupler and a phenol coupler can be used as cyan couplers. These couplers are preferably non-diffusing couplers containing a hydrophobic ballast group. The couplers may be either four equivalent or two equivalent relative to silver ion. In addition, colored couplers having the effect of color correction or so-called development inhibitor releasing (DIR) couplers releasing a development inhibitor as development progresses can be used. In addition to the DIR couplers, colorless DIR coupling compounds which provide a colorless coupling reaction product and release a development inhibitor may be used.

The light-sensitive material of the present invention may contain ultraviolet absorbers in the hydrophilic colloid layers thereof. Ultraviolet absorbers which can be used include benzotriazole compounds substituted with an aryl group, 4-thiazolidone compounds, benzophenone compounds, cinnamic acid ester compounds, butadiene compounds, and benzooxazole compounds. In addition, ultraviolet absorbing polymers can be used. These ultraviolet absorbers may be fixed in the hydrophilic colloid layers.

The photographic emulsions as used herein may be spectrally sensitized using methine dyes and so forth. These sensitizing dyes may be used alone or in combination with each other. A combination of sensitizing dyes is often used for the purpose of supersensitization. Dyes which do not have a spectral sensitization action by themselves or substances not materially absorbing visible light but exhibiting strong color sensitization may be present in the emulsions in combination with the sensitizing dyes.

Useful sensitizing dyes, dye combinations exhibiting supersensitization, and substances showing supersensitization are described in *Research Disclosure,* Vol. 176, No. 17643 (published December 1978), page 23, Chapter IV, Clause J.

Known anti-fading agents as described hereinafter can be used in combination in the practice of the present invention. Color image stabilizers as used herein can be used alone or in combination with each other. Known anti-fading agents which can be used include hydroquinone derivatives, gallic acid derivatives, p-alkoxyphenols, p-oxyphenol derivatives, and bisphenols.

Typical examples of the hydroquinone derivatives are described in U.S. Pat. Nos. 2,360,290, 2,418,613, 2,675,314, 2,701,197, 2,704,713, 2,728,659, 2,732,300, 2,735,765, 2,710,801, 2,816,028, and British Pat. No. 1,363,921. Typical examples of the gallic acid derivatives are described in U.S. Pat. Nos. 3,457,079 and 3,069,262. Typical examples of the p-alkoxyphenols are described in U.S. Pat. Nos. 2,735,765, 3,698,909, Japanese Patent Publication Nos. 20977/74 and 6623/77. Typical examples of the p-oxyphenol derivatives are described in U.S. Pat. Nos. 3,432,300, 3,573,050, 3,574,627, 3,764,337, Japanese Patent Application (OPI) Nos. 35633/77, 147434/77 and 152225/77. Typical examples of the bisphenols are described in U.S. Pat. Nos. 3,700,455.

The present invention is applicable to a multi-layer polychromatic photographic material comprising a support and at least two layers with different spectral sensitivities. These multi-layer polychromatic photographic materials usually comprise a support and at least one red-sensitive silver halide emulsion layer, at least one green-sensitive silver halide emulsion layer, and at least one blue-sensitive silver halide emulsion layer. The order in which these layers are present on the support is not critical and can be determined appropriately. Usually a cyan-forming coupler is present in the red-sensitive emulsion layer; a magenta-forming coupler, in the green-sensitive emulsion layer; and a yellow-forming coupler, in the blue-sensitive emulsion layer. In some cases, however, other combinations can be employed.

Known techniques and known processing solutions as described in *Research Disclosure,* No. 176, pages 28–30 (RD-17643) can be used in photographic processing of the light-sensitive material of the present invention. This photographic processing may be either a black and white photographic processing to form a silver image or a color photographic processing to form a dye image. The processing temperature is usually chosen within the range of from about 18° to about 50° C. Lower temperatures than about 18° C. or higher temperatures than about 50° C. may be employed.

Color developers generally comprise alkaline aqueous solutions containing color developing agents. Known primary aromatic amine developers, such as phenylenediamines (e.g., 4-amino-N,N-dimethylaniline, 3-methyl-4-amino-N,N-dimethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, and 4-amino-3-methyl-N-ethyl-N-β-methoxyethylaniline) can be used as the color developing agents.

In addition, the compounds described in L. F. A. Mason, *Photographic Processing Chemistry,* the Focal Press, (1966), pages 226–229, U.S. Pat. Nos. 2,193,015, 2,592,364, and Japanese Patent Application (OPI) No. 64933/73 can be used.

After color development, the photographic emulsion layers are usually bleached. This bleaching may be performed simultaneously with fixing or the bleaching and fixing may be performed separately. Compounds of polyvalent metals, such as iron (III), cobalt (III), chromium (VI), and copper (II), peracids, quinones, nitroso compounds, and so forth can be used as bleaching agents.

For example, ferricyanides, dichromates, organic complex salts of iron (II) or cobalt (III), and complex salts of organic acids such as aminopolycarboxylic acids (e.g., ethylenediaminetetraacetic acid, nitrilotriacetic acid, and 1,3-diamino-2-propanoltetraacetic acid), citric acid, tartaric acid, and malic acid; persulfates and permanganates; and nitrosophenol can be used. Of these compounds, potassium ferricyanide, iron (III) sodium ethylenediaminetetraacetate, and iron (III) ammonium ethylenediaminetetraacetate are especially useful. Ethylenediaminetetraacetic acid iron (III) complex salts are useful in both an independent bleaching solution of a monobath bleach-fixing solution.

As a special developing technique, a method may be employed in which a developing agent or auxiliary developing agent is incorporated in a light-sensitive material, e.g., an emulsion layer thereof, and the light-sensitive material is developed by treatment in an alkaline aqueous solution or developer.

The present invention is described in greater detail with reference to the following examples. Unless otherwise indicated, all parts, percents, ratios and the like are by weight.

EXAMPLE 1

Sample A

Polyethylene containing 7.5% by weight of anatase type titanium oxide was coated on a paper having a basis weight of 180 g/m$^2$ in a thickness of 40 $\mu$m to prepare a support. This polyethylene layer is hereinafter abbreviated as "PE layer". On this support were coated a first layer to an eighth layer as described in Tables 1 and 2 below to produce a light-sensitive material, Sample A.

Sample B

Sample B was produced in the same manner as in the preparation of Sample A except that the first and second layers were omitted.

SAMPLE C

Sample C was produced in the same manner as in the preparation of Sample A except that the PE layer of the support contained 0.20% by weight of a 1:1 mixture of bluish ultramarine No. 2000 and red pigment, Daiichi Pink D.P-1, in addition to the titanium oxide.

Sample D

Sample D was produced in the same manner as in the preparation of Sample A except that the PE layer of the support had the same formulation as in Sample C and the first and second layers were omitted.

Sample E

Sample E was produced in the same manner as in the preparation of Sample C except that the PE layer of the support contained 0.30% by weight of a 1:1 mixture of bluish ultramarine No. 2000 and D.P-1.

Sample F

Sample F was produced in the same manner as in the preparation of Sample A except that the PE layer of the support had the same formulation as in Sample E and the first and second layers were omitted.

Each light-sensitive sample was exposed stepwise to blue light, green light and red light, and then developed as follows:

| | Temperature (°C.) | Time (min.) |
|---|---|---|
| Development | 33 | 3.5 |
| Bleach-Fixing | 33 | 1.5 |
| Rinsing | 28–35 | 3 |

| | |
|---|---|
| Developer | |
| Benzyl Alcohol | 15 ml |
| Diethylenetriaminepentaacetic Acid | 5 g |
| KBr | 0.4 g |
| $Na_2SO_3$ | 5 g |
| $Na_2CO_3$ | 30 g |
| Hydroxylamine Sulfate | 2 g |
| 4-Amino-3-methyl-N—ethyl-N—$\beta$-(methanesulfonamido)ethylaniline.3/2 $H_2SO_4.H_2O$ | 4.5 g |
| Water to make | 1000 ml (pH = 10.1) |
| Bleach-Fixing Solution | |
| Ammonium Thiosulfate (70% by weight aq. solution) | 150 ml |
| $Na_2SO_3$ | 5 g |
| Na[Fe(EDTA)] | 40 g |
| EDTA | 4 g |
| Water to make | 1000 ml (pH = 6.8) |

TABLE 1

| | |
|---|---|
| Eighth Layer (Protective layer) | |
| Gelatin | 1000 mg/m$^2$ |
| Seventh Layer (Red-sensitive layer) | |
| Silver Chlorobromide Emulsion (Br: 50 mol %) | 300 mg/m$^2$ (calculated as silver) |
| Gelatin | 1000 mg/m$^2$ |
| Cyan Coupler*1 | 400 mg/m$^2$ |
| Coupler Solvent*2 | 200 mg/m$^2$ |
| Sixth Layer (Intermediate layer) | |
| Gelatin | 1200 mg/m$^2$ |
| Ultraviolet Absorber*3 | 1000 mg/m$^2$ |
| Ultraviolet Absorber Solvent*2 | 250 mg/m$^2$ |
| Fifth Layer (Green-sensitive layer) | |
| Silver Chlorobromide Emulsion (Br: 50 mol %) | 200 mg/m$^2$ (calculated as silver) |
| Gelatin | 1000 mg/m$^2$ |
| Magenta Coupler*4 | 300 mg/m$^2$ |
| Coupler Solvent*5 | 600 mg/m$^2$ |
| Fourth Layer (Intermediate layer) | |
| Gelatin | 1000 mg/m$^2$ |
| Third Layer (Blue-sensitive layer) | |
| Silver Chlorobromide Emulsion (Br: 80 mol %) | 400 mg/m$^2$ (calculated as silver) |
| Gelatin | 1200 mg/m$^2$ |
| Yellow Coupler*6 | 300 mg/m$^2$ |
| Coupler Solvent*7 | 150 mg/m$^2$ |
| Second Layer | |
| Gelatin | 2.6 g/m$^2$ |
| First Layer | |
| Gelatin | 1.3 g/m$^2$ |
| Titanium Oxide | 8.9 g/m$^2$ |

*1Coupler: 2-[$\alpha$-(2,4-Di-tert-pentylphenoxy)butaneamido-4,6-dichloro-5-methylphenol
*2Solvent: Dibutyl phthalate
*3Ultraviolet Absorber: 2-(2-Hydroxy-3-sec-butyl-5-tert-butylphenyl)benzotriazole
*4Coupler: 1-(2,4,6-Trichlorophenyl)-3-(2-chloro-5-tetradecaneamido)anilino-4-{(2-n-butoxy-5-tert-octyl)phenylthio}-2-pyrazolin-5-one
*5Solvent: Tricresyl phosphate
*6Coupler: $\alpha$-Pivaloyl-$\alpha$-(2,4-dioxo-5,5'-dimethyl-oxazolidin-3-yl)-2-chloro-5-[$\alpha$-(2,4-di-tert-pentylphenoxy)butaneamido]acetoanilide
*7Solvent: Dioctylbutyl phosphate

TABLE 2

| | Sample | | | | | |
|---|---|---|---|---|---|---|
| | A | B | C | D | E | F |
| Second Layer | | | | | | |
| Gelatin | 2.6 g/m$^2$ | — | 2.6 g/m$^2$ | — | 2.6 g/m$^2$ | — |
| First Layer | | | | | | |
| Gelatin | 1.3 g/m$^2$ | — | 1.3 g/m$^2$ | — | 1.3 g/m$^2$ | — |
| Titanium Dioxide | 8.9 g/m$^2$ | — | 8.9 g/m$^2$ | — | 8.9 g/m$^2$ | — |
| Dye | not present | — | not present | — | not present | — |
| PE Layer | | | | | | |
| Titanium Dioxide | 7.5 wt % | Same as | 7.5 wt % | Same as | 7.5 wt % | Same as |
| DP-1 | not present | in | 0.20 wt % | in | 0.30 wt % | in |
| Ultramarine | not present | Sample A | | Sample C | | Sample E |

The density of each colored material was then measured to determine its photographic characteristics.

The degree of whiteness was measured according to JIS Z8722, 8730.

The MT value, described in T. H. James ed., *The Theory of the Photographic Process,* 4th ed., page 526, unexposed Samples A to F were measured of and the sharpness of the samples were compared. The MT value means that the closer it is to 1.0, the better is the sharpness; in printing an image, the image is less discolored or blurred. All the MT values shown in the present specification are experimental values when the green-sensitive silver halide emulsion layer was measured at a space frequency of 10 cycle/mm. It is to be noted, however, that the effect of the present invention is not limited to the green-sensitive emulsion layer or the space frequency.

The results obtained are shown in Table 3 below.

TABLE 3

| Sample | Relative Sensitivity: Blue Sensitive Layer | Green Sensitive Layer | Red Sensitive Layer | Surface Reflection Characteristics: L | a | b | MT Value (10 cycle/mm) |
|---|---|---|---|---|---|---|---|
| A | 98 | 102 | 105 | 97.5 | 0 | 2.1 | 0.61 |
| B | 100 | 100 | 100 | 96.2 | 0.2 | 1.8 | 0.43 |
| C | 98 | 98 | 95 | 96.8 | 0.9 | −0.3 | 0.65 |
| D | 100 | 93 | 90 | 92.3 | 1.4 | −3.1 | 0.46 |
| E | 98 | 95 | 93 | 91.4 | 1.5 | −2.8 | 0.72 |
| F | 93 | 80 | 74 | 86.7 | 4.0 | −7.2 | 0.48 |

The following conclusions can be drawn from the results shown in Table 3 above.

Sample A has a disadvantage in that the color is not satisfactory.

Sample B is most inferior in sharpness.

Sample C is relatively satisfactory in color and sharpness, but is inferior to Sample E.

Sample D possesses a performance identical to those of many color papers now commercially available, but the sharpness is not satisfactory.

Sample F is not satisfactory in color.

In summary, it can be seen that Sample E is the best.

EXAMPLE 2

Samples G to K were prepared in the same manner as used for Sample A except that the dye shown in Table 4 below was introduced into the first layer of Sample A.

TABLE 4

| Sample | Second Layer | First Layer: Gelatin | Oxide | Dye | PE Layer |
|---|---|---|---|---|---|
| A | Same as in Example 1 | | | | |

TABLE 4-continued

| Sample | Second Layer | First Layer: Gelatin | Oxide | Dye | PE Layer |
|---|---|---|---|---|---|
| G | " | " | " | No. 12 (25 mg/m$^2$) | " |
| H | " | " | " | No. 31 (2 mg/m$^2$) | " |
| I | " | " | " | No. 28 (30 mg/m$^2$) | " |
| J | " | " | " | No. 21 (2 mg/m$^2$) | " |
| K | " | " | " | Dye-1* (1.5 mg/m$^2$) | " |

Note:
*Dye-1:

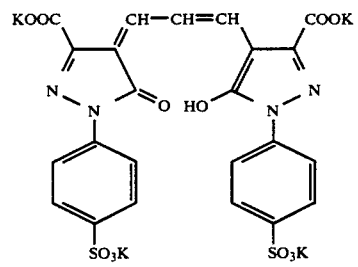

Each sample was then processed and tested in the same manner as described in Example 1. The results obtained are shown in Table 5 below.

TABLE 5

| Sample | Relative Sensitivity: Blue Sensitive Layer | Green Sensitive Layer | Red Sensitive Layer | Surface Reflection Characteristics: L | a | b | MTF (10 cycle/mm) |
|---|---|---|---|---|---|---|---|
| A | 100 | 100 | 100 | 97.5 | 0 | 2.1 | 0.61 |
| G | 100 | 100 | 98 | 96.2 | 1.3 | −2.0 | 0.66 |
| H | 100 | 98 | 100 | 95.8 | 1.5 | −3.6 | 0.64 |
| I | 100 | 100 | 98 | 95.9 | −0.1 | −2.5 | 0.65 |
| J | 100 | 98 | 100 | 96.0 | 1.0 | −3.2 | 0.66 |
| K | 100 | 95 | 98 | 97.5 | 0 | 2.1 | 0.65 |

It can be seen from the results in Table 5, the Samples G, H, I and J are superior to Comparative Samples A and K in both the degree of whiteness and sharpness. The reason why the degree of whiteness of Sample K is low is considered to be due to the fact that the dye flows out of the layer during processing.

EXAMPLE 3

Sample L was produced in the same manner as in the preparation of Sample G of Example 2 except that the amount of titanium oxide in the first layer (white pigment-containing hydrophilic colloid layer) was changed to 2 g/m$^2$.

Sample M was produced in the same manner as in the preparation of Sample L above except that the amount of the dye in the first layer was changed to 10 g/m$^2$.

The photographic characteristics, degree of whiteness, and CTF of Samples L and M were measured in the same manner as described in Example 1. The results obtained are shown in Table 6 below along with those of Sample G.

TABLE 6

| Sample | Relative Sensitivity: Blue Sensitive Layer | Green Sensitive Layer | Red Sensitive Layer | Surface Reflection Characteristics: L | a | b | MTF (10 cycle/mm) |
|---|---|---|---|---|---|---|---|
| A | 100 | 100 | 100 | 97.5 | 0 | 2.1 | 0.61 |
| G | 100 | 100 | 98 | 96.2 | 1.3 | −2.0 | 0.66 |
| L | 100 | 98 | 95 | 90.6 | 1.7 | −6.3 | 0.54 |
| M | 100 | 100 | 98 | 94.0 | 1.2 | −2.4 | 0.50 |

The following conclusions can be drawn from the results shown in Table 6 above.

Sample L in which the amount of titanium oxide was small has low sensitivity and is subject to a serious reduction in lightness (L).

Sample M in which the amounts of titanium oxide and dye were both small is improved over Sample L in both sensitivity and the degree of whiteness. In this case, however, the reduction in CTF is serious as compared with Sample G of the present invention.

While the invention has been described in detail and with reference to specific embodiments thereof, it will be apparent to one skilled in the art that various changes and modifications can be made therein without departing from the spirit and scope thereof.

What is claimed is:

1. A photographic paper material comprising (1) a support comprised of a paper substrate which is coated on both sides with a synthetic hydrophobic resin film, (2) a hydrophilic colloid layer containing a white pigment provided on one side of the support (1), and (3) a light-sensitive silver halide emulsion layer on the hydrophilic colloid layer (2), wherein a dye or pigment having an absorption within the region of 500 to 800 nm and which is not decolored during photographic processing is present in the hydrophilic colloid layer (2) and/or the synthetic resin film of the support (1), wherein the colloid layer contains not less than 30% by volume of white pigment, and wherein the dye or pigment which is not decolored is present in an amount such that the surface reflection characteristics of the hydrophilic colloid layer containing the white pigment as measured and expressed according to JIS Z 8730 fall within the ranges of L=90 or more, A=0.5 to 1.5 and b=(−3) to (−5).

2. The material as claimed in claim 1, wherein the synthetic resin film is a polyethylene film.

3. The material as claimed in claim 1, wherein the white pigment is titanium dioxide.

4. The material as claimed in claim 1, wherein the hydrophilic colloid layer (2) containing a white pigment contains said dye or pigment which is not decolored during photographic processing.

5. The material as claimed in claim 1, wherein said hydrophilic colloid layer is in contact with said synthetic resin film on one side of the support, and said synthetic resin film which is in contact with the hydrophilic colloid layer contains said dye or pigment not decolored during photographic processing.

6. The material as claimed in claim 1, wherein the resin film is a polyolefin film.

7. The material as claimed in claim 1, wherein white pigment is present in the resin film.

8. The material as claimed in claim 1, wherein the dye or pigment which is not decolored is present in the synthetic resin film layer and is employed in an amount such that the surface reflection rate of the resin layer determined according to JIS Z 8730 is 70% or less at 400 to 700 nm.

* * * * *